US005328792A

United States Patent [19]

Shigemori et al.

[11] Patent Number: 5,328,792

[45] Date of Patent: Jul. 12, 1994

[54] NON-MAGNETIC ONE-COMPONENT DEVELOPER AND DEVELOPMENT PROCESS

[75] Inventors: Kazunori Shigemori, Tokyo; Katsuhiro Hasegawa; Jun Saito, both of Kawasaki, all of Japan

[73] Assignee: Nippon Zeon Co., Ltd., Tokyo, Japan

[21] Appl. No.: 912,397

[22] Filed: Jul. 13, 1992

[30] Foreign Application Priority Data

Jul. 24, 1991 [JP] Japan ..... 3-207605
Jun. 26, 1992 [JP] Japan ..... 4-193183

[51] Int. Cl.[5] ..... G03G 9/083

[52] U.S. Cl. ..... 430/106.6; 430/109; 430/110; 430/111; 430/120; 430/125; 430/126; 430/903

[58] Field of Search ..... 430/106.6, 109, 110, 430/111, 120, 125, 126, 903

[56] References Cited

U.S. PATENT DOCUMENTS 4,554,234 11/1985 Imai et al. ..... 430/122
4,571,372 2/1986 Urawa et al. ..... 430/122
4,769,676 9/1988 Mukai et al. ..... 355/15
4,985,327 1/1991 Sakashita et al. ..... 430/106.6
5,051,332 9/1991 Hosoya et al. ..... 430/122
5,169,738 12/1992 Tanikawa et al. ..... 430/106.6
5,175,070 12/1992 Tanikawa et al. ..... 430/122

FOREIGN PATENT DOCUMENTS 241160 3/1987 European Pat. Off. .
330498 2/1989 European Pat. Off. .
445986 3/1991 European Pat. Off. .
62-203182 9/1987 Japan .
3-7972 1/1991 Japan .
2091435 12/1981 United Kingdom .
2131565 9/1983 United Kingdom .

*Primary Examiner*—John Kight, III
*Assistant Examiner*—Shelley Dodson
*Attorney, Agent, or Firm*—Lowe, Price, LeBlanc & Becker

[57] ABSTRACT

A non-magnetic one-component developer comprises a binder resin and a colorant, and has a volume-average particle diameter (dv) in a range of 5–15 μm, a ratio (dv/dn) of the volume-average particle diameter (dv) to the number-average particle diameter (dn) in a range of 1.00–1.40, a quotient (Sc/Sr) obtained by dividing the area (Sc) of a circle supposing the absolute maximum length of a particle is a diameter by the real projected area (Sr) of the particle in a range of 1.00–1.30, a product (AxdnxD) of the specific surface area (A) ($m^2/g$) as measured in accordance with the BET method, the number-average particle diameter (dn) (μm) and the true specific gravity (D) in a range of 5–10, and a ratio (Q/A) of the charge level (Q) (μc/g) to the specific surface area (A) in a range of 80–150. The developer is substantially spherical from both conditions of Sc/Sr and AxdnxD, and is suitable for use in a development process in which cleaning is conducted at the same time as development. A development process making use of the non-magnetic one-component developer is also disclosed.

4 Claims, 2 Drawing Sheets

NON-MAGNETIC ONE-COMPONENT DEVELOPER AND DEVELOPMENT PROCESS

FIELD OF THE INVENTION

The present invention relates to an improved non-magnetic one-component developer suitable for use in a development process in which cleaning is conducted at the same time as development in an electrophotographic apparatus or an electrostatic recording apparatus, and a development process.

BACKGROUND OF THE INVENTION

Image-forming apparatus such as electrophotographic apparatus and electrostatic recording apparatus, in which a prescribed latent image on a photosensitive drum is rendered visible, are generally equipped with a cleaning device for removing a developer remaining on the photosensitive drum.

For example, an image-forming apparatus of such a construction as schematically illustrated in section in FIG. 1 is generally used. This apparatus is provided with a photosensitive drum (1), a cleaning device (2) equipped with a cleaning blade (2*a*) disposed about the photosensitive drum, a charging device (3), an exposing device (4), a developing device (5), a development roll (8), a transferring device (6) and the like. The surface of the photosensitive drum (1), which has been charged to a desired extent by the charging device (3), is selectively exposed by the exposing device (4), thereby forming a latent image. An area of the latent image is developed. with a developer (toner) by making use of the developing device (5). A toner image thus developed is transferred to a transfer paper sheet (7) by the transferring device (6). After completion of the transfer process, the toner remaining on the photosensitive drum (1) is removed by the cleaning blade (2*a*) of the cleaning device (2).

However, the above-described apparatus involves a problem that since the remaining toner accumulated in the cleaning device must be discarded, its maintenance is complicated, and pollution of the circumference of the apparatus and environment is brought about. In addition, the photosensitive drum is worn due to the friction with the cleaning blade, so that the image-forming characteristics and life of the image-forming apparatus are lowered. Furthermore, the provision of the cleaning device results in reduction in degree of freedom in its design.

In order to solve such problems, it has been proposed to use a one-component developer and conduct development and cleaning at the same time by the same developing device (Japanese Patent Application Laid-Open Nos. 203182/1987 and 7972/1991).

A schematic cross-sectional view of an exemplary image-forming apparatus for achieving such a process is illustrated in FIG. 2. Incidentally, in FIG. 2, the character (9) indicates a layer-thickness regulator for toner, and other characters designate members or devices respectively corresponding to those of the same characters in FIG. 1.

In the process making use of the apparatus illustrated in FIG. 2 to conduct development and cleaning at the same time, the toner remaining on the photosensitive drum after completion of a transfer process is recovered within the developing device according to the following principle. Namely, a surface potential of an unexposed area (non-latent-image area) and a surface potential of an exposed area (latent-image area) of the photosensitive drum (1), and a development bias voltage applied to the development roll (8) are supposed to be Vo, Vq and Vb, respectively, and a surface potential Ve of the development roll (8) is assumed to be identical with the development bias voltage Vb. The electrostatic latent image formed on the photosensitive drum is developed in reversal fashion with a one-component developer (toner) charged to the same polarity as the electric charge of the latent image.

In this reversal development, the above-described surface potentials are preset so as to satisfy the following relationship:

$$|Vo| > |Ve| > |Vq|$$

wherein Vo, Ve and Vq have the same polarity. In the latent-image area on the photosensitive drum, force toward the photosensitive drum is exerted on the toner on the development roll by a potential difference $|Ve-Vq|$, thereby conducting development. After completion of the transfer process, force toward the development roll is exerted on the toner remaining on the non-latent-image area by a potential difference $|Vo-Ve|$, thereby recovering the remaining toner, i.e., cleaning the photosensitive drum. According to this simultaneous process of development and cleaning, the conventional cleaning device becomes unnecessary.

In this development process, a toner layer uniform and thin in thickness is also formed on the development roll (8) by the layer-thickness regulator for toner (9). Further, as a toner, there is used a non-magnetic one-component developer comprising a binder resin and a colorant, containing no magnetic powder and having a high specific resistance.

It was however found from the results of an experiment by the present inventors that when a potential difference $|Ve-Vq|$ is made great with a view toward attaining a sufficient image density, a potential difference $|Vo-Ve|$ required to recover the remaining toner becomes small, so that cleaning becomes incomplete and the formation of ghost images occurs. On the contrary, when the potential difference $|Vo-Ve|$ is made great with a view toward improving the cleaning ability, the potential difference $|Ve-Vq|$ required for the development becomes small, so that it is impossible to attain a satisfactory image density. If the transferability of the toner on the photosensitive drum to transfer paper is poor and the toner hence remains thereon to a great extent, it is necessary to properly control the respective surface potentials Vo, Ve and Vq and moreover to regulate the thickness of a toner layer formed on the development roll and the rotational ratio of the photosensitive drum to the development roll so as to keep the amount of the toner required for the development proper, thereby making the amount of the toner remaining on the photosensitive drum after completion of the transfer small, in order to satisfy both image density and cleaning ability. The latitude of these proper conditions is extremely limited, so that it is difficult to properly control them.

OBJECTS AND SUMMARY OF THE INVENTION

It is an object of this invention to provide an improved non-magnetic one-component developer, which can satisfy both image density and cleaning ability in a development process in which cleaning is conducted at the same time as development.

The present inventors found that the conventional non-magnetic one-component developers are insufficient to satisfy both image density and cleaning ability in the development process in which cleaning is conducted at the same time as development, and have carried out an extensive investigation with a view toward developing a satisfactory non-magnetic one-component developer. As a result, it has been found that a non-magnetic one-component developer composed of substantially spherical particles having specific physical properties is excellent in transferability, and hence can provide a good image free of any ghost images because a toner remaining on a photosensitive drum is effectively cleaned at the same time as development.

When this improved non-magnetic one-component developer is used, the transfer efficiency of the toner becomes high, so that each latitude of the proper conditions with respect to the above-described surface potentials Vo, Ve and Vq, the thickness of a toner layer formed on a development roll, and the rotational ratio of the photosensitive drum to the development roll can be widened.

The present invention has been led to completion on the basis of this finding.

According to the present invention, there is thus provided a non-magnetic one-component developer suitable for use in a development process in which a development roll for bearing a developer layer charged to the same polarity as the electric charge of a latent image formed on a photosensitive drum is disposed in a relation opposite to a photosensitive drum, and the remaining developer adhered to a non-latent-image area on the photosensitive drum is attracted toward the development roll at the same time as the development of a latent image on the photosensitive drum to remove the remaining developer, thereby cleaning the photosensitive drum, characterized in that the non-magnetic one-component developer comprises a binder resin and a colorant, and has the following physical properties:

(a) the volume-average particle diameter (dv) ranging from 5 to 15 μm;

(b) the ratio (dv/dn) of the volume-average particle diameter (dv) to the number-average particle diameter (dn) ranging from 1.00 to 1.40;

(c) the quotient (Sc/Sr) obtained by dividing the area (Sc) of a circle supposing the absolute maximum length of a particle is a diameter by the real projected area (Sr) of the particle ranging from 1.00 to 1.30;

(d) the product (AxdnxD) of the specific surface area (A) ($m^2/g$) as measured in accordance with the BET method, the number-average particle diameter (dn) (μm) and the true specific gravity (D) ranging from 5 to 10; and (e) the ratio (Q/A) of the charge level (Q) (μc/g) to the specific surface area (A) ranging from 80 to 150, said non-magnetic one-component developer being substantially spherical from the conditions of (c) and (d).

According to the present invention, there is also provided a development process, which comprises using the non-magnetic one-component developer as a developer.

<Measurement methods of physical properties>

Methods and apparatus for measuring the physical properties of developers in the present invention are as follows.

(1) Sc/Sr is a value obtained by measuring and analyzing a developer by an image processing and analyzing apparatus under the following conditions:

Image processing and analyzing apparatus:
Luzex IID (manufactured by Nikore K. K.)
Percent area of a particle to a frame area:
Maximum 2%
Total number of particles processed: 1,000 particles
(The Sc/Sr value is expressed in terms of a number-average value of the 1,000 particles)

(2) The specific surface area (A) as measured in accordance with the BET method is a value measured by means of an automatic specific surface area meter, "Model 2200" manufactured by Shimadzu Corporation (3) Both volume-average particle diameter (dv) and number-average particle diameter (dn) are values measured by means of a Coulter counter ("Model TA-II", manufactured by Nikkaki K. K.).

(4) The true specific gravity (D) is a value measured by a Beckmann specific gravimeter.

(5) The charge level (Q) (μc/g) is a value measured in accordance with the blow-off method after mixing a toner with a carrier, "TEFV 150/250, " so as to give a toner concentration of 5% and stirring the mixture for 30 minutes at a rotational speed of 150 rpm.

DETAILED DESCRIPTION OF THE INVENTION

Figure 1:
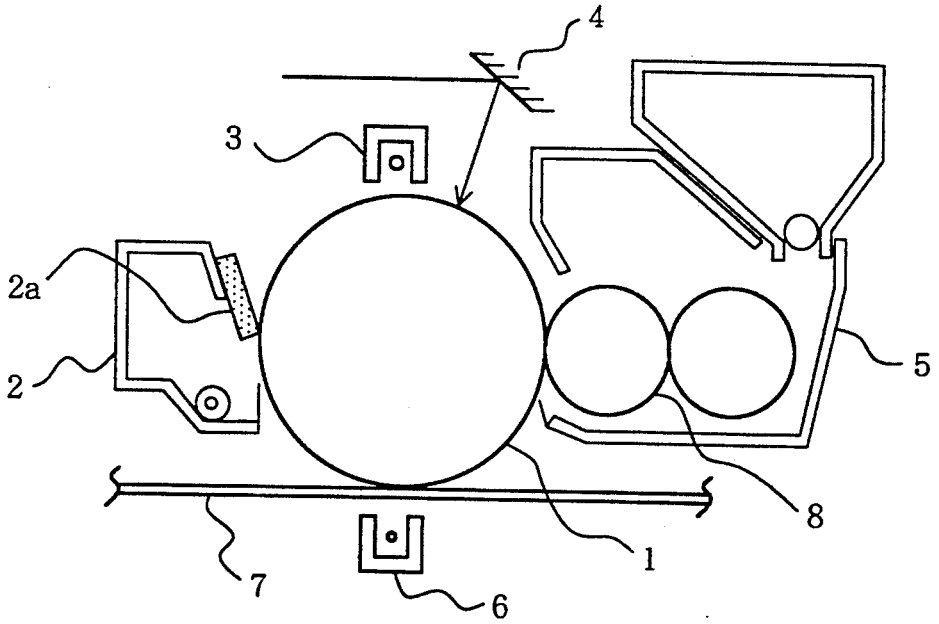
FIG. 1 is a schematic cross-sectional view illustrating an illustrative construction of an image-forming apparatus generally used.

Features of the present invention will hereinafter be described in detail.

Toners have heretofore been prepared by melting and kneading a mixture containing a binder resin and a colorant, cooling the thus-kneaded mixture, grinding it by a grinder and then classifying the thus-ground mixture to make its particle diameter uniform. However, particles of the toners obtained by such a grinding system are indeterminate in shape. In such a toner, the quotient (Sc/Sr) obtained by dividing the area (Sc) of a circle supposing the absolute maximum length of a particle is a diameter by the real projected area (Sr) of the particle generally exceeds 1.3. In addition, its specific surface area (A) as measured in accordance with the BET method becomes great, and the product (AxdnxD) of the specific surface area (A) ($m^2/g$), the number-average particle diameter (dn) (μm) and the true specific gravity (D) exceeds 10.

When a toner having the shape and properties as described above is used as a developer in the above-described development process in which cleaning is conducted at the same time as development, each latitude of the proper conditions as to the above-described surface potentials Vo, Ve and Vq, the thickness of a toner layer formed on a development roll, and the rotational ratio of the photosensitive drum to the development roll for satisfying both image density and cleaning ability becomes extremely narrow because its transfer efficiency to transfer paper is as low as 60–90%.

On the other hand, the present inventors have found that when a non-magnetic one-component toner having such properties that the volume-average particle diameter (dv) is in a range of 5–15 μm, the ratio (dv/dn) of the volume-average particle diameter (dv) to the number-average particle diameter (dn) is in a range of 1.00–1.40, the quotient (Sc/Sr) obtained by dividing the area (Sc) of a circle supposing the absolute maximum length of a particle is a diameter by the real projected area (Sr) of the particle is in a range of 1.00–1.30, the product (AxdnxD) of the specific surface area (A) ($m^2/g$) as measured in accordance with the BET method, the number-average particle diameter (dn) (μm) and the true specific gravity. (D) is in a range of 5–10, and the ratio (Q/A) of the charge level (Q) (μc/g) to the specific surface area (A) is in a range of 80–150, said toner being substantially spherical from the conditions of the shape factor (Sc/Sr) and the product (AxdnxD), is used as a developer in the above-described simultaneous development-cleaning process, the transfer efficiency is improved to 90–99%.

If particles not satisfying the above-described conditions as to the shape factor (Sc/Sr) and the product (AxdnxD) are used as a toner, the transfer efficiency of the toner becomes low, so that the image density becomes insufficient, and scumming in non-image areas, image unevenness and formation of ghost images occur on a resulting image.

The use of any non-magnetic toners whose volume-average particle diameter (dv) is smaller than 5 μm or exceeds 15 μm fails to make a layer of the toner on the development roll uniform, or makes the transfer efficiency poor, so that a sufficient image density cannot be attained.

If a non-magnetic toner having such a wide particle size distribution as the volume-average particle diameter (dv) to number-average particle diameter (dn) ratio (dv/dn) exceeds 1.40 is used, the supply of the toner becomes extremely unstable upon long-term continuous development. A preferred dv/dn value is within a range of 1.00–1.25.

If a toner whose charge level (Q) (μc/g) to specific surface area (A) ratio (Q/A) is lower than 80 or exceeds 150 is used, a sufficient image density cannot be attained, or a resulting image is full of scumming in non-image areas. A preferred Q/A value is within a range of 90–140.

Therefore, when the toner according to this invention is used, each latitude of the proper conditions with respect to the above-described surface potentials Vo, Ve and Vq, the thickness of a toner layer formed on a development roll, and the rotational ratio of the photosensitive drum and development roll for satisfying both image density and cleaning ability can be widened.

The non-magnetic one-component toner according to the present invention can be obtained by polymerizing an intimate mixture containing at least one vinyl monomer and at least one colorant by a suspension polymerization process.

As an exemplary specific suspension polymerization process, may be mentioned a process in which a mixture comprising a vinyl monomer, a colorant and a radical polymerization initiator, and as optional components, various kinds of additives is intimately dispersed by a ball mill or the like to prepare an intimate liquid mixture and the thus-obtained intimate liquid mixture is then finely dispersed in water under high-shear stirring into an aqueous dispersion, thereby subjecting the dispersion to suspension polymerization at a temperature of 30°–200° C. in general.

As exemplary vinyl monomers useful in the practice of this invention, may be mentioned styrene monomers such as styrene, vinyltoluene and α-methylstyrene; acrylic acid, methacrylic acid and their derivatives such as methyl acrylate, ethyl acrylate, propyl acrylate, butyl acrylate, 2-ethylhexyl acrylate, ethyl methacrylate, propyl methacrylate, butyl methacrylate, 2-ethylhexyl methacrylate, dimethylaminoethyl methacrylate, acrylonitrile and acrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; nitrogen-containing vinyl compounds such as 2-vinylpyridine, 4-vinylpyridine and N-vinylpyrrolidone; and the like. These vinyl monomers may be used either singly or in combination.

In addition to these vinyl monomers, optional crosslinking agents may be used. As exemplary crosslinking agents, may be mentioned aromatic divinyl compounds such as divinylbenzene, divinylnaphthalene and derivatives thereof; ethylenically unsaturated dicarboxylic esters, such as ethylene glycol dimethacrylate and diethylene glycol dimethacrylate; divinyl compounds such as N,N-divinylaniline and divinyl ether; and compounds containing at least three vinyl groups. These crosslinking agents may be used either singly or in combination.

As exemplary colorants useful in the practice of this invention, may be mentioned pigments and dyes such as carbon black, aniline black, crystal violet, rhodamine B, malachite green, nigrosine, copper phthalocyanine and azo dyes. These colorants may be used either singly or in combination.

In addition, one or more of high-polar substances referred to as charge control agent in this field, such as nigrosine dyes, monoazo dyes, metallized dyes, zinc hexadecylsuccinate, alkyl esters or alkyl amides of naphthoic acid, nitrohumic acid, N,N'-tetramethyldiamine benzophenone, N,N'-tetramethylbenzidine, triazine and metal complexes of salicylic acid may be contained.

It is also possible to simultaneously contain or subsequently add, into the non-magnetic toner according to this invention, at least one of various additives for controlling charge characteristics, electric conductivity, flowability or adhesion properties to a photosensitive member or fixing roll. Examples of such additives include releasing agents such as low-molecular weight polypropylene, low-molecular weight polyethylene, various kinds of waxes and silicone oils; inorganic fine powders such as carbon black powder, silica powder, alumina powder, titanium oxide powder, zinc oxide powder, cerium oxide powder and calcium oxide powder; and the like.

ADVANTAGES OF THE INVENTION

According to this invention, there can be provided improved non-magnetic one-component developers which can satisfy both image density and cleaning ability in a development process in which cleaning is conducted at the same time as development. In addition, there can also be provided a development process making use of the toner.

The non-magnetic one-component developers according to this invention are excellent in transferability, and hence permit the formation of high-density and vivid images free of any ghost images because the toner remaining on a photosensitive drum is effectively cleaned at the same time as development. They are high in transfer efficiency, so that each latitude of the proper conditions with respect to the surface potentials Vo, Ve and Vq, the thickness of a toner layer formed on a development roll, and the rotational ratio of the photosensitive drum and development roll can be widened.

With respect to an image-forming apparatus in which cleaning is conducted at the same time as development, the use of the non-magnetic one-component developers according to this invention also permits the realization of an apparatus which is small in size and low in price, and requires no maintenance. The non-magnetic one-component developers according to this invention can thus bring about many advantages from the viewpoint of practical use.

EMBODIMENTS OF THE INVENTION

The present invention will hereinafter be described specifically by the following Examples and Comparative Examples. However, it should be borne in mind that this invention is not limited to these examples only. Incidentally, all designations of "part" or "parts" and "%" as will be used in the following Examples and Comparative Examples mean part or parts by weight and wt. % unless expressly noted.

EXAMPLE 1

Dispersed in a ball mill, were 90 parts of styrene, 10 parts of stearyl methacrylate, 4 parts of low-molecular weight polypropylene, 7 parts of carbon black ("Black Pearl 130", trade name), 0.5 part of a Cr dye ("Bontron S-34", trade name) and 2 parts of 2,2'-azobis(2,4-dimethylvaleronitrile), thereby obtaining an intimate liquid mixture.

The liquid mixture was then added into 350 parts of purified water with 3 parts of calcium phosphate finely dispersed therein to obtain an aqueous dispersion. The thus-obtained aqueous dispersion was subjected to high-shear agitation by a rotor-stator type homomixer under conditions of pH 9 or higher to finely disperse the liquid mixture in water. This aqueous dispersion was then charged in a reactor equipped with an agitating blade to conduct polymerization for 4 hours at 65° C. under stirring.

After the thus-obtained polymer dispersion was thoroughly washed with an acid and then water, the resultant polymer was separated and dried to obtain a toner material.

Subsequently, 0.3 part of hydrophobic silica as a flowability-imparting agent was added to 100 parts of the toner material to obtain a non-magnetic one-component toner. The non-magnetic one-component toner thus obtained was composed of substantially spherical particles having properties shown in Table 1.

EXAMPLE 2

Dispersed in a ball mill, were 80 parts of styrene, 20 parts of 2-ethylhexyl acrylate, 4 parts of low-molecular weight polypropylene, 7 parts of carbon black ("Printex 150T" trade name), 0.5 part of a Cr dye ("Bontron S-34", trade name) and 2 parts of 2,2'-azobis(2,4-dimethylvaleronitrile), thereby obtaining an intimate liquid mixture.

The liquid mixture was then added into 350 parts of purified water with 3 parts of calcium phosphate finely dispersed therein to obtain an aqueous dispersion. The thus-obtained aqueous dispersion was subjected to high-shear agitation by a rotor-stator type homomixer under conditions of pH 9 or higher to finely disperse the liquid mixture in water. This aqueous dispersion was then charged in a reactor equipped with an agitating blade to conduct polymerization for 4 hours at 65° C. under stirring.

After the thus-obtained polymer dispersion was thoroughly washed with an acid and then water, the resultant polymer was separated and dried to obtain a toner material.

Subsequently, 0.3 part of hydrophobic silica as a flowability-imparting agent was added to 100 parts of the toner material to obtain a non-magnetic one-component toner. The non-magnetic one-component toner thus obtained was composed of substantially spherical particles having properties shown in Table 1.

EXAMPLE 3

A non-magnetic one-component toner was obtained in the same manner as in Example 1 except that 400 parts of purified water with 4.5 parts of calcium phosphate finely dispersed therein were used. The non-magnetic one-component toner thus obtained was composed of substantially spherical particles having properties shown in Table 1.

Comparative Example 1

A non-magnetic one-component toner was obtained in the same manner as in Example 2 except that 70 parts of styrene and 30 parts of butyl methacrylate were used. The non-magnetic one-component toner thus obtained was composed of substantially spherical particles having properties shown in Table 1.

Comparative Example 2

Dispersed in a ball mill, were 90 parts of styrene, 10 parts of stearyl methacrylate, 4 parts of low-molecular weight polypropylene, 3 parts of carbon black ("Black Pearl 130", trade name), 2.0 part of a Cr dye ("Bontron S-34", trade name) and 2 parts of 2,2'-azobis (2,4-dimethylvaleronitrile), thereby obtaining an intimate liquid mixture.

The liquid mixture was then added into 350 parts of purified water with 3 parts of calcium phosphate finely dispersed therein to obtain an aqueous dispersion. The thus-obtained aqueous dispersion was subjected to high-shear agitation by a rotor-stator type homomixer under conditions of pH 9 or higher to finely disperse the liquid mixture in water. This aqueous dispersion was then charged in a reactor equipped with an agitating blade to conduct polymerization for 4 hours at 65° C. under stirring.

After the thus-obtained polymer dispersion was thoroughly washed with an acid and then water, the resultant polymer was separated and dried to obtain a toner material.

Subsequently, 0.3 part of hydrophobic silica as a flowability-imparting agent was added to 100 parts of the toner material to obtain a non-magnetic one-component toner. The non-magnetic one-component toner thus obtained was composed of substantially spherical particles having properties shown in Table 1.

Comparative Example 3

After melting and kneading 100 parts of a styrene-butyl methacrylate copolymer (styrene to butyl methacrylate ratio=70:30), 7 parts of carbon black ("Printex 150T", trade name), 1.0 part of a Cr dye ("Bontron S-34", trade name) and 4 parts of low-molecular weight polypropylene in a kneader, the resulting mixture was ground in a jet mill and then subjected to air classification, thereby obtaining a toner material.

Subsequently, 0.3 part of hydrophobic silica as a flowability-imparting agent was added to 100 parts of the toner material to obtain a non-magnetic one-component toner. The non-magnetic one-component toner thus obtained had a shape factor (Sc/Sr) of 1.53 and a product (AxdnxD) of 14.6 as shown in Table 1, and was hence composed of particles having different particle forms.

<Image evaluation of non-magnetic one-component toner>

Figure 2:
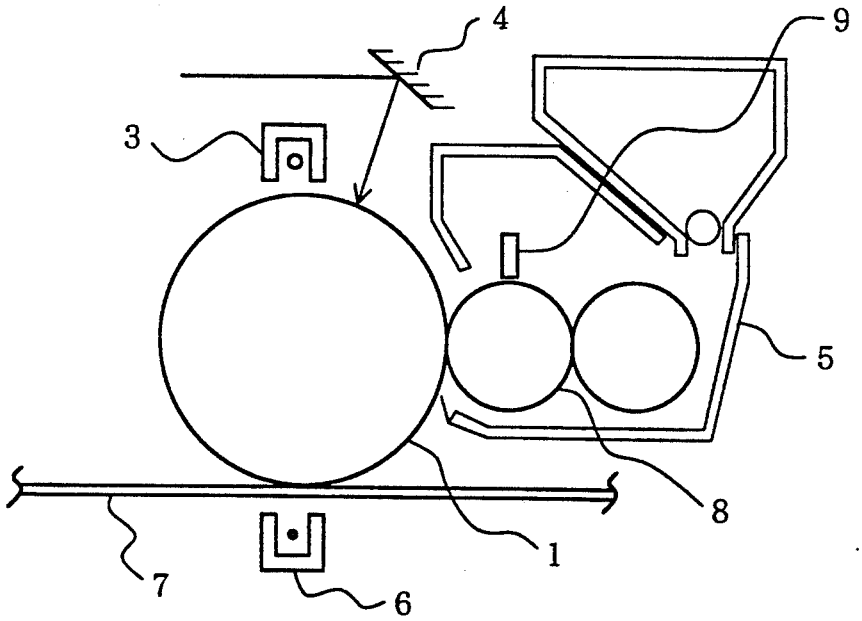
FIG. 2 is a schematic cross-sectional view illustrating an illustrative construction of an image-forming apparatus to which a non-magnetic one-component developer according to this invention can be applied.

With respect to the non-magnetic toners obtained in Examples 1-3 and Comparative Examples 1-3, the evaluation of images was performed by means of an apparatus containing a developing machine of the contact development system, which basically has the construction illustrated in FIG. 2 and comprises a photosensitive drum (1) making use of an organic photosensitive member, a development roll (8) comprising an electroconductive support of a metallic core and a rubbery toner-bearing layer provided on the outer peripheral surface of the support, and a layer-thickness regulator (9) for toner, which is made of a urethane rubber. The evaluation results of images are shown in Table 1.

TABLE 1

| | Ex. 1 | Ex. 2 | Ex. 3 | Comp. Ex. 1 | Comp. Ex. 2 | Comp. Ex. 3 |
|---|---|---|---|---|---|---|
| Properties of toner | | | | | | |
| Volume-average particle diameter (dv) (μm) | 11.7 | 12.0 | 6.5 | 12.1 | 11.8 | 12.0 |
| Volume-average particle diameter (dv)/ number-average particle diameter (dn) (dv/dn) | 1.20 | 1.21 | 1.18 | 1.21 | 1.15 | 1.28 |
| Shape factor (Sc/Sr) | 1.05 | 1.04 | 1.07 | 1.05 | 1.13 | 1.53 |
| BET specific surface area (A) ($m^2/g$) | 0.68 | 0.67 | 0.92 | 0.65 | 0.72 | 1.42 |
| True specific gravity (D) | 1.08 | 1.10 | 1.10 | 1.09 | 1.10 | 1.10 |
| Product (AxdnxD) | 7.2 | 7.3 | 5.6 | 7.2 | 7.4 | 14.6 |
| Charge level (Q) (μc/g) | 88 | 61 | 110 | 39 | 115 | 45 |
| Q/A ratio | 130 | 91 | 120 | 60 | 160 | 32 |
| Evaluation results of image | | | | | | |
| Transferability (*1) | 4.0 | 7.0 | 8.5 | 17.8 | 30.0 | 25.0 |
| Potential difference required for (*2) recovery of toner (V) | 150 | 160 | 180 | (*9) | 300 | 250 |
| Fog of photosensitive member (*3) | 2.0 | 5.0 | 4.7 | 53.0 | 3.0 | 16.2 |
| Image density (ID) (*4) | 1.32 | 1.31 | 1.35 | 1.40 | 1.02 | 1.44 |
| Scumming in non-image areas (*5) | Not occurred | Not occurred | Not occurred | Occurred | Not occurred | Not occurred |
| Image unevenness (*6) | Not occurred | Not occurred | Not occurred | Not occurred | Occurred | Not occurred |
| Dust (*7) | Not occurred | Not occurred | Not occurred | Occurred | Occurred | Not occurred |
| Ghost image (*8) | Not occurred | Not occurred | Not occurred | Occurred | Occurred | Occurred |

(*1) Transferability: After completion of transfer, a toner remaining on the photosensitive drum was transferred to a paper sheet by a mending tape to measure the reflectance of such a paper sheet by a whiteness meter ("Whiteness Meter NDW-1D", manufactured by Nippon Denshoku Kogyo K.K.). The transferability of each toner was expressed in terms of a value found by subtracting the value of this reflectance from the value of a reflectance measured by the whiteness meter in the case where a mending tape alone was stuck on a paper sheet. The greater the value, the more the remaining toner.

(*2) Potential difference required for the recovery of toner: This potential difference is a potential difference between a bias voltage applied to the development roll and a surface potential of the photosensitive drum at the time any ghost images have become disappeared when varying the bias voltage.

(*3) Fog of photosensitive member: The toner of a fogged area on the photosensitive drum was transferred to a paper sheet by a mending tape to measure the reflectance of such a paper sheet by the whiteness meter. The fog of the photosensitive member was expressed in terms of a value found by subtracting the value of this reflectance from the value of a reflectance measured by the whiteness meter in the case where a mending tape alone was stuck on a paper sheet. The greater the value, the more the fog of the photosensitive member.

(*4) Image density: The image density was determined by measuring a black solid area by a Macbeth reflection densitometer.

(*5)-(*8) Scumming in non-image areas, image unevenness, dust and ghost image: Image properties such as scumming in non-image areas, image unevenness, dust and ghost image were judged by visually observing 20,000 copies obtained by means of the developing apparatus illustrated in FIG. 2.

(*9) Ghost images remained appearing due to great fog of the photosensitive member.

As apparent from the results shown in Table 1, the toners obtained in Examples 1-3 were excellent in transferability to transfer paper, so that the potential difference $|Vo-Ve|$ required for the recovery of the toner remaining on the photosensitive drum was small compared with the toners obtained in Comparative Examples 1-3 and having poor transferability. Therefore, the use of such toners permitted the provision of images free of any ghost images and high in image density over a wide range of the development bias voltage applied to the development roll. In addition, the resulting images were free of any scumming in non-image areas, dust, unevenness and ghost images, and hence vivid during twenty thousand-sheet copying.

The toner obtained in Comparative Example 1, which was composed of substantially spherical particles, but had a charge level (Q) to specific surface area (A) ratio (Q/A) lower than 80, was great in fog of the photosensitive member and also poor in transferability, so that it was impossible to provide an image high in image density and free of any ghost images even when varying the development bias voltage in any way.

The toner obtained in Comparative Example 2, which was composed of substantially spherical particles, but had a charge level (Q) to specific surface area (A) ratio (Q/A) higher than 150, provided an image low in image density and full of image unevenness and dust. The toner was also poor in transferability, so that ghost images appeared when continuously copied though the development bias voltage was preset to a proper value.

The toner obtained in Comparative Example 3 and composed of particles having different particle shapes was able to provide an image free of any scumming in non-image areas, dust and unevenness. However, it was poor in transferability. Therefore, although the development bias voltage was preset to a proper value, ghost images appeared in some cases due to a narrow latitude of the proper value when continuously copied.

We claim:

1. A non-magnetic one-component developer suitable for use in a development process in which a development roll for bearing a developer layer charged to the same polarity as the electric charge of a latent image formed on a photosensitive drum is disposed in a relation opposite to a photosensitive drum, and the remaining developer adhered to a non-latent-image area on the photosensitive drum is attracted toward the development roll at the same time as the development of a latent image on the photosensitive drum to remove the remaining developer, thereby cleaning the photosensitive drum, characterized in that the non-magnetic one-component developer comprises a binder resin and a colorant, and has the following physical properties:

(a) the volume-average particle diameter (dv) ranging from 5 to 15 μm;

(b) the ratio (dv/dn) of the volume-average particle diameter (dv) to the number-average particle diameter (dn) ranging from 1.00 to 1.40;

(c) the quotient (Sc/Sr) obtained by dividing the area (Sc) of a circle supposing the absolute maximum length of a particle is a diameter by the real projected area (Sr) of the particle ranging from 1.00 to 1.30;

(d) the product (AxdnxD) of the specific surface area (A) ($m^2/g$) as measured in accordance with the BET method, the number-average particle diameter (dn) (μm) and the true specific gravity (D) ranging from 5 to 10; and (e) the ratio (Q/A) of the charge level (Q) (μc/g) to the specific surface area (A) ranging from 80 to 150, said non-magnetic one-component developer being substantially spherical from the conditions of (c) and (d).

2. The non-magnetic one-component developer as claimed in claim 1, which has been obtained by polymerizing an intimate mixture containing at least one vinyl monomer and at least one colorant according to a suspension polymerization process.

3. A development process in which a development roll for bearing a layer of a developer charged to the same polarity as the electric charge of a latent image formed on a photosensitive drum is disposed in a relation opposite to a photosensitive drum, and the remaining developer adhered to a non-latent-image area on the photosensitive drum is attracted toward the development roll at the same time as the development of a latent image on the photosensitive drum to remove the remaining developer, thereby cleaning the photosensitive drum, which comprises using, as the developer, a non-magnetic one-component developer comprising a binder resin and a colorant, and having the following physical properties:

(a) the volume-average particle diameter (dv) ranging from 5 to 15 μm;

(b) the ratio (dv/dn) of the volume-average particle diameter (dv) to the number-average particle diameter (dn) ranging from 1.00 to 1.40;

(c) the quotient (Sc/Sr) obtained by dividing the area (Sc) of a circle supposing the absolute maximum length of a particle is a diameter by the real projected area (Sr) of the particle ranging from 1.00 to 1.30;

(d) the product (AxdnxD) of the specific surface area (A) ($m^2/g$) as measured in accordance with the BET method, the number-average particle diameter (dn) (μm) and the true specific gravity (D) ranging from 5 to 10; and (e) the ratio (Q/A) of the charge level (Q) (μc/g) to the specific surface area (A) ranging from 80 to 150, said non-magnetic one-component developer being substantially spherical from the conditions of (c) and (d).

4. The process as claimed in claim 3, which comprises using a non-magnetic one-component developer obtained by polymerizing an intimate mixture containing at least one vinyl monomer and at least one colorant according to a suspension polymerization process.

* * * * *